US011108144B2

(12) United States Patent
Chuang

(10) Patent No.: US 11,108,144 B2
(45) Date of Patent: Aug. 31, 2021

(54) ANTENNA STRUCTURE

(71) Applicant: Wistron Corp., New Taipei (TW)

(72) Inventor: Shih Ming Chuang, New Taipei (TW)

(73) Assignee: WISTRON CORP., New Taipei (TW)

( * ) Notice: Subject to any disclaimer, the term of this patent is extended or adjusted under 35 U.S.C. 154(b) by 86 days.

(21) Appl. No.: 16/689,752

(22) Filed: Nov. 20, 2019

(65) Prior Publication Data

US 2021/0126355 A1 Apr. 29, 2021

(30) Foreign Application Priority Data

Oct. 23, 2019 (TW) ..... 108138171

(51) Int. Cl.

*H01Q 19/24* (2006.01)
*H01Q 1/24* (2006.01)
*H01Q 1/38* (2006.01)

(52) U.S. Cl.

CPC ..... *H01Q 1/38* (2013.01); *H01Q 1/243* (2013.01); *H01Q 1/245* (2013.01); *H01Q 19/24* (2013.01)

(58) Field of Classification Search

CPC ..... H01Q 1/36; H01Q 1/38; H01Q 1/243; H01Q 19/22; H01Q 19/24; H01Q 5/30; H01Q 5/307; H01Q 5/357; H01Q 5/364; H01Q 5/371

See application file for complete search history.

(56) References Cited

U.S. PATENT DOCUMENTS 10,418,697 B2 * 9/2019 Kashiwagi ..... H01Q 21/30
2009/0073048 A1 * 3/2009 Kim ..... H01Q 9/30 343/700 MS
2009/0079639 A1 * 3/2009 Hotta ..... H01Q 1/243 343/702
2009/0135071 A1 * 5/2009 Huang ..... H01Q 9/0421 343/700 MS (Continued)

FOREIGN PATENT DOCUMENTS

CN 106033834 B 5/2019
TW M326236 U 1/2008

OTHER PUBLICATIONS

Chinese language office action dated May 22, 2020, issued in application No. TW 108138171.

*Primary Examiner* — Jason Crawford
(74) *Attorney, Agent, or Firm* — McClure, Qualey & Rodack, LLP

(57) ABSTRACT

An antenna structure includes a feeding radiation element, a first radiation element, a second radiation element, and a third radiation element. The feeding radiation element has a feeding point. The first radiation element is coupled to a first connection point on the feeding radiation element. The first radiation element includes a bending portion. The second radiation element is coupled to a second connection point on the feeding radiation element, and is adjacent to the bending portion of the first radiation element. The second radiation element is not parallel to the first radiation element. The third radiation element has a grounding point, and is coupled to a third connection point on the feeding radiation element. The third radiation element includes a first protruding portion and a second protruding portion. The first protruding portion and the second protruding portion of the third radiation element extend in different directions.

16 Claims, 5 Drawing Sheets

(56) References Cited

U.S. PATENT DOCUMENTS

| | | | | |
|---|---|---|---|---|
| 2012/0218151 | A1* | 8/2012 | Wong | H01Q 1/38 343/700 MS |
| 2013/0069842 | A1* | 3/2013 | Lee | H01Q 21/28 343/853 |
| 2014/0132469 | A1* | 5/2014 | Wang | H01Q 5/371 343/821 |
| 2018/0278287 | A1* | 9/2018 | Nishikawa | H01Q 5/335 |
| 2019/0020111 | A1* | 1/2019 | Tseng | H01Q 1/48 |
| 2019/0115652 | A1* | 4/2019 | Yun | H01Q 1/422 |
| 2020/0411987 | A1* | 12/2020 | Lo | H01Q 1/48 |

* cited by examiner

ANTENNA STRUCTURE

CROSS REFERENCE TO RELATED APPLICATIONS

This application claims priority of Taiwan Patent Application No. 108138171 filed on Oct. 23, 2019, the entirety of which is incorporated by reference herein.

BACKGROUND OF THE INVENTION

Field of the Invention

The disclosure generally relates to an antenna structure, and more particularly, to a wideband antenna structure.

Description of the Related Art

With the advancements being made in mobile communication technology, mobile devices such as portable computers, mobile phones, multimedia players, and other hybrid functional portable electronic devices are becoming more common. To satisfy consumer demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some devices cover a small wireless communication area; these include mobile phones using Wi-Fi and Bluetooth systems and using frequency bands of 2.4 GHz, 5.2 GHz and 5.8 GHz.

Antennas are indispensable elements for wireless communication. If an antenna used for signal reception and transmission has insufficient bandwidth, it will tend to degrade the communication quality of the mobile device. Accordingly, it has become a critical challenge for antenna designers to design a wideband antenna element that is small in size.

BRIEF SUMMARY OF THE INVENTION

In an exemplary embodiment, the invention is directed to an antenna structure that includes a feeding radiation element, a first radiation element, a second radiation element, and a third radiation element. The feeding radiation element has a feeding point. The first radiation element is coupled to a first connection point on the feeding radiation element. The first radiation element includes a bending portion. The second radiation element is coupled to a second connection point on the feeding radiation element, and is adjacent to the bending portion of the first radiation element. The second radiation element is not parallel to the first radiation element. The third radiation element has a grounding point, and is coupled to a third connection point on the feeding radiation element. The third radiation element includes a first protruding portion and a second protruding portion. The first protruding portion and the second protruding portion of the third radiation element extend in different directions.

In some embodiments, the feeding radiation element substantially has a relatively narrow straight-line shape.

In some embodiments, an acute angle is formed between the second radiation element and the bending portion of the first radiation element.

In some embodiments, the second radiation element substantially has a relatively wide straight-line shape.

In some embodiments, the second radiation element is substantially perpendicular to the feeding radiation element.

In some embodiments, the first radiation element and the second radiation element are positioned at a side of the feeding radiation element, and the third radiation element is positioned at an opposite side of the feeding radiation element.

In some embodiments, a monopole slot is formed between the feeding radiation element and the third radiation element.

In some embodiments, the feeding point and the grounding point are positioned at two opposite sides of the monopole slot.

In some embodiments, the first protruding portion of the third radiation element substantially has a relatively narrow rectangular shape or a relatively narrow trapezoidal shape.

In some embodiments, the second protruding portion of the third radiation element substantially has a relatively wide rectangular shape.

In some embodiments, the first protruding portion and the second protruding portion of the third radiation element substantially extend in orthogonal directions.

In some embodiments, the first protruding portion and the second protruding portion of the third radiation element substantially extend in opposite directions.

In some embodiments, the antenna structure covers a first frequency band and a second frequency band. The first frequency band is from 2400 MHz to 2500 MHz. The second frequency band is from 5150 MHz to 5850 MHz.

In some embodiments, a first resonant path is formed from the feeding point through the first connection point to an open end of the first radiation element. The length of the first resonant path is substantially equal to 0.25 wavelength of the first frequency band.

In some embodiments, a second resonant path is formed from the feeding point through the second connection point to an open end of the second radiation element. The length of the second resonant path is substantially equal to 0.25 wavelength of the first frequency band.

In some embodiments, a third resonant path is formed from the grounding point through the third radiation element to an open end of the first protruding portion. The length of the third resonant path is substantially equal to 0.25 wavelength of the second frequency band.

In some embodiments, a fourth resonant path is formed from the grounding point through the third radiation element to an open end of the second protruding portion. The length of the fourth resonant path is substantially equal to 0.25 wavelength of the second frequency band.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

Figure 1:
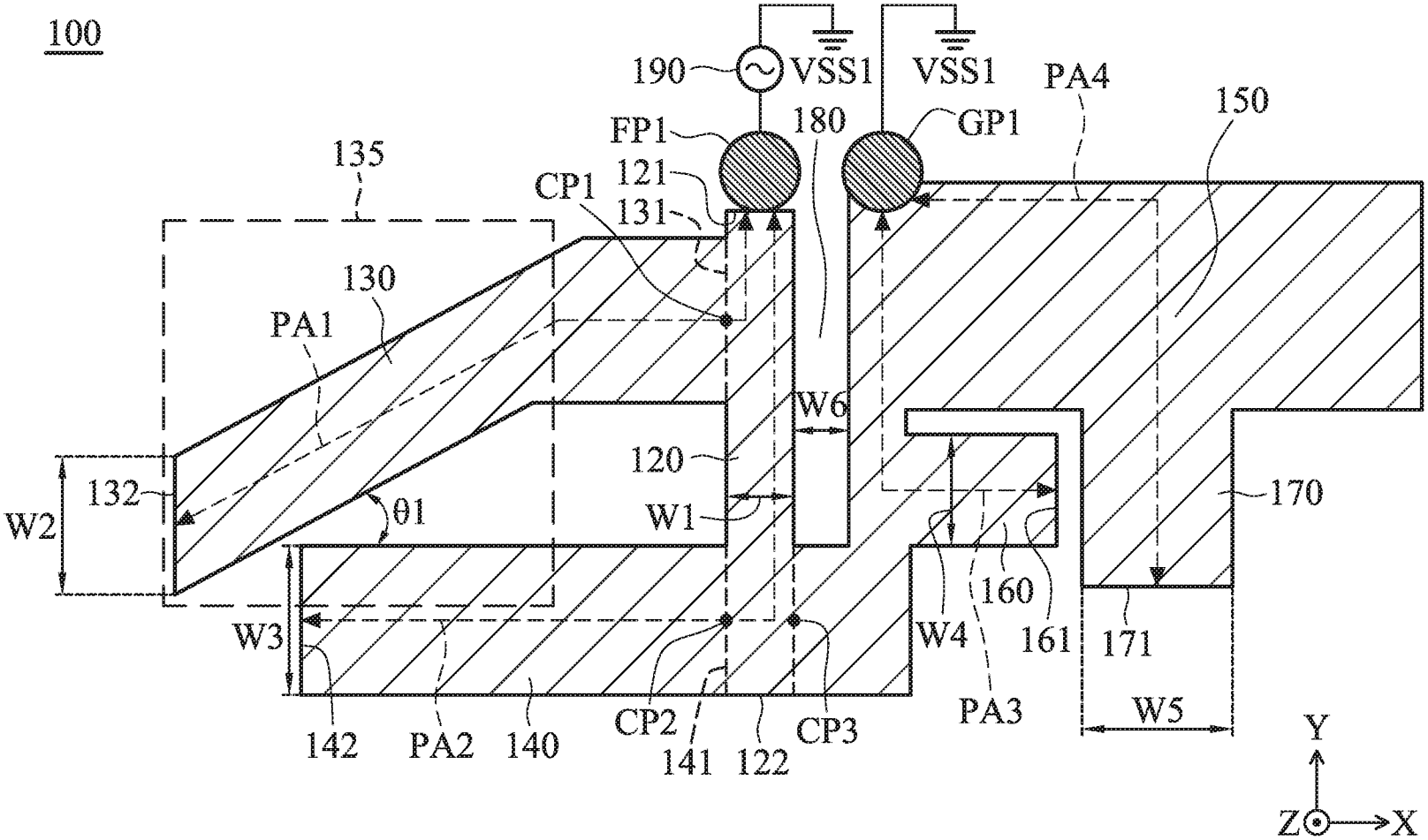
FIG. 1 is a diagram of an antenna structure according to an embodiment of the invention.

In order to illustrate the foregoing and other purposes, features and advantages of the invention, the embodiments and figures of the invention will be described in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

FIG. 1 is a diagram of an antenna structure 100 according to an embodiment of the invention. The antenna structure 100 may be applicable to a mobile device, such as a smart phone, a tablet computer, or a notebook computer. In the embodiment of FIG. 1, the antenna structure 100 includes a feeding radiation element 120, a first radiation element 130, a second radiation element 140, and a third radiation element 150. The feeding radiation element 120, the first radiation element 130, the second radiation element 140, and the third radiation element 150 may all be made of metal materials, such as copper, silver, aluminum, iron, or their alloys. In some embodiments, the antenna structure 100 is disposed on a dielectric substrate (not shown), such as a FR4 (Flame Retardant 4) substrate, a PCB (Printed Circuit Board), or an FCB (Flexible Circuit Board).

The antenna structure 100 has a feeding point FP1 and a grounding point GP1. The feeding point FP1 may be coupled to a signal source 190, such as an RF (Radio Frequency) module, for exciting the antenna structure 100. The grounding point GP1 may be coupled to a ground voltage VSS1. In some embodiments, the ground voltage VSS1 is provided by a system ground plane of the antenna structure 100 (not shown).

The feeding radiation element 120 may substantially have a relatively narrow straight-line shape. Specifically, the feeding radiation element 120 has a first end 121 and a second end 122. The feeding point FP1 is positioned at the first end 121 of the feeding radiation element 120. A first connection point CP1, a second connection point CP2, and a third connection point CP3 are respectively at different positions on the feeding radiation element 120. The first connection point CP1 is adjacent to the first end 121 of the feeding radiation element 120. The second connection point CP2 and the third connection point CP3 are opposite to each other, and both of them are adjacent to the second end 122 of the feeding radiation element 120. It should be noted that the term "adjacent" or "close" over the disclosure means that the distance (spacing) between two corresponding elements is smaller than a predetermined distance (e.g., 5 mm or the shorter), or means that the two corresponding elements directly touch each other (i.e., the aforementioned distance/spacing therebetween is reduced to 0). In some embodiments, the first radiation element 130 and the second radiation element 140 are positioned at a side (e.g., the left side) of the feeding radiation element 120, and the third radiation element 150 is positioned at an opposite side (e.g., the right side) of the feeding radiation element 120.

The first radiation element 130 includes a bending portion 135, which may substantially have a parallelogram shape. Specifically, the first radiation element 130 has a first end 131 and a second end 132. The first end 131 of the first radiation element 130 is coupled to the first connection point CP1 on the feeding radiation element 120. The second end 132 of the first radiation element 130 is an open end. The bending portion 135 of the first radiation element 130 is positioned at the second end 132 of the first radiation element 130.

The second radiation element 140 may substantially have a relatively wide straight-line shape, which may be substantially perpendicular to the feeding radiation element 120. Specifically, the second radiation element 140 has a first end 141 and a second end 142. The first end 141 of the second radiation element 140 is coupled to the second connection point CP2 on the feeding radiation element 120. The second end 142 of the second radiation element 140 is an open end. The second end 142 of the second radiation element 140 is adjacent to the bending portion 135 of the first radiation element 130, but is completely separate from the bending portion 135 of the first radiation element 130. The second radiation element 140 is not parallel to the first radiation element 130. For example, an acute angle θ1 may be formed between the second radiation element 140 and the bending portion 135 of the first radiation element 130.

The third radiation element 150 may have an irregular shape. The grounding point GP1 is positioned at a corner of the third radiation element 150. The third radiation element 150 is coupled to the third connection point CP3 of the feeding radiation element 120. Specifically, the third radiation element 150 includes a first protruding portion 160 and a second protruding portion 170. The first protruding portion 160 of the third radiation element 150 may substantially have a relatively narrow rectangular shape with an open end 161. The second protruding portion 170 of the third radiation element 150 may substantially have a relatively wide rectangular shape with an open end 171. The first protruding portion 160 and the second protruding portion 170 of the third radiation element 150 substantially extend in orthogonal directions. For example, the open end 161 of the first protruding portion 160 may extend parallel to the +X axis, and the open end 171 of the second protruding portion 170 may extend parallel to the −Y axis, but they are not limited thereto. In some embodiments, a monopole slot 180 is formed between the feeding radiation element 120 and the third radiation element 150. The feeding point FP1 and the grounding point GP1 are positioned at two opposite sides of the monopole slot 180. That is, the monopole slot 180 is positioned between the feeding point FP1 and the grounding point GP1.

Figure 2:
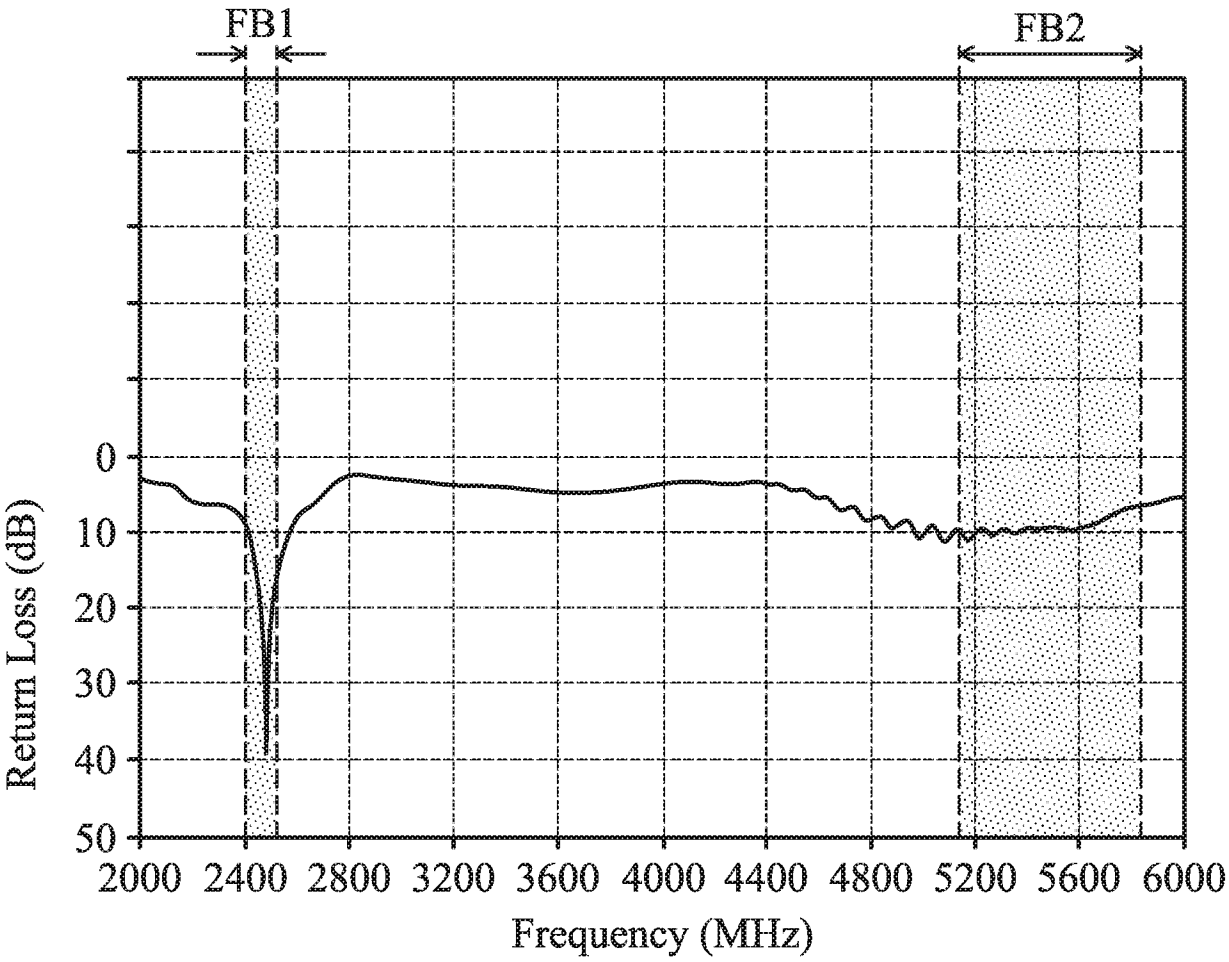
FIG. 2 is a diagram of return loss of an antenna structure according to an embodiment of the invention.

FIG. 2 is a diagram of return loss of the antenna structure 100 according to an embodiment of the invention. The horizontal axis represents the operation frequency (MHz), and the vertical axis represents the return loss (dB). According to the measurement of FIG. 2, the antenna structure 100 can cover a first frequency band FB1 and a second frequency band FB2. The first frequency band FB1 may be from 2400 MHz to 2500 MHz. The second frequency band FB2 may be from 5150 MHz to 5850 MHz. Accordingly, the antenna structure 100 can at least support the wideband operation of WLAN (Wireless Local Area Networks) 2.4 GHz/5 GHz.

Figure 3:
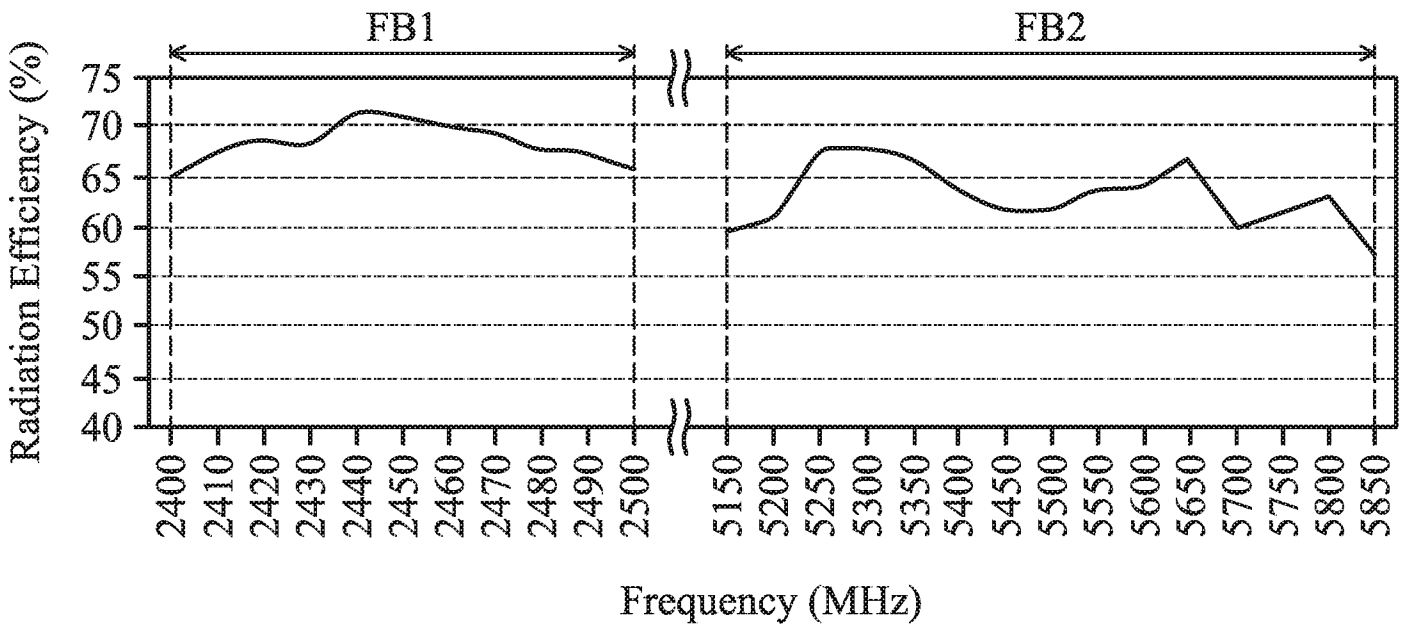
FIG. 3 is a diagram of radiation efficiency of an antenna structure according to an embodiment of the invention.

FIG. 3 is a diagram of radiation efficiency of the antenna structure 100 according to an embodiment of the invention. The horizontal axis represents the operation frequency (MHz), and the vertical axis represents the radiation efficiency (%). According to the measurement of FIG. 3, within the first frequency band FB1 and the second frequency band FB2, the radiation efficiency of the antenna structure 100 can reach 55% or higher, and it can meet the requirements of practical application of general mobile communication devices.

In some embodiments, the operation principles of the antenna structure 100 are described as follows. A first resonant path PA1 is formed from the feeding point FP1 through the first connection point CP1 to the second end 132 of the first radiation element 130. A second resonant path PA2 is formed from the feeding point FP1 through the second connection point CP2 to the second end 142 of the second radiation element 140. Both the first resonant path PA1 and the second resonant path PA2 are excited to generate the first frequency band FB1. A third resonant path PA3 is formed from the grounding point GP1 through the third radiation element 150 to the open end 161 of the first protruding portion 160. A fourth resonant path PA4 is formed from the grounding point GP1 through the third radiation element 150 to the open end 171 of the second protruding portion 170. Both the third resonant path PA3 and the fourth resonant path PA4 are excited to generate the second frequency band FB2.

In some embodiments, the element sizes of the antenna structure 100 are described as follows. The length of the first resonant path PA1 may be substantially equal to 0.25 wavelength ($\lambda/4$) of the first frequency band FB1. The length of the second resonant path PA2 may be substantially equal to 0.25 wavelength ($\lambda/4$) of the first frequency band FB1. The length of the third resonant path PA3 may be substantially equal to 0.25 wavelength ($\lambda/4$) of the second frequency band FB2. The length of the fourth resonant path PA4 may be substantially equal to 0.25 wavelength ($\lambda/4$) of the second frequency band FB2. The width W2 of the first radiation element 130 may be 2 to 3 times the width W1 of the feeding radiation element 120. The width W3 of the second radiation element 140 may be substantially equal to the width W2 of the first radiation element 130. Among the third radiation element 150, the width W5 of the second protruding portion 170 may be 1.1 to 1.5 times the width W4 of the first protruding portion 160. The width W6 of the monopole slot 180 may be from 1 mm to 2 mm. The acute angle $\theta 1$ may be from 0 to 45 degrees. The above ranges of element sizes are calculated and obtained according to many experiment results, and they help to optimize the operation bandwidth and impedance matching of the antenna structure 100.

Figure 4:
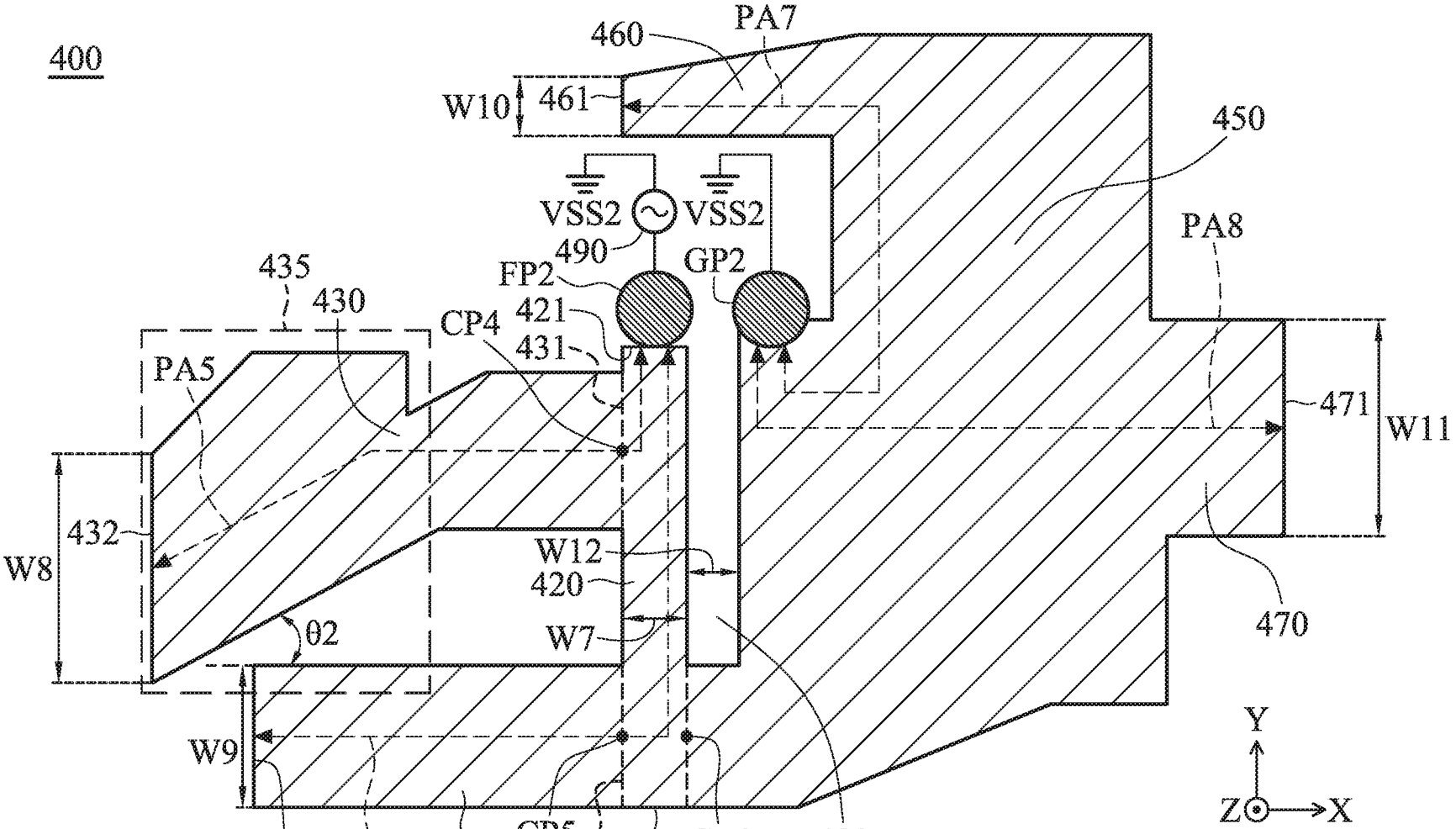
FIG. 4 is a diagram of an antenna structure according to another embodiment of the invention.

FIG. 4 is a diagram of an antenna structure 400 according to another embodiment of the invention. In the embodiment of FIG. 4, the antenna structure 400 includes a feeding radiation element 420, a first radiation element 430, a second radiation element 440, and a third radiation element 450. The feeding radiation element 420, the first radiation element 430, the second radiation element 440, and the third radiation element 450 may all be made of metal materials.

The antenna structure 400 has a feeding point FP2 and a grounding point GP2. The feeding point FP2 may be coupled to a signal source 490 for exciting the antenna structure 400. The grounding point GP2 may be coupled to a ground voltage VSS2.

The feeding radiation element 420 may substantially have a relatively narrow straight-line shape. Specifically, the feeding radiation element 420 has a first end 421 and a second end 422. The feeding point FP2 is positioned at the first end 421 of the feeding radiation element 420. A first connection point CP4, a second connection point CP5, and a third connection point CP6 are respectively at different positions on the feeding radiation element 420. The first connection point CP4 is adjacent to the first end 421 of the feeding radiation element 420. The second connection point CP5 and the third connection point CP6 are opposite to each other, and both of them are adjacent to the second end 422 of the feeding radiation element 420. In some embodiments, the first radiation element 430 and the second radiation element 440 are positioned at a side of the feeding radiation element 420, and the third radiation element 450 is positioned at an opposite side of the feeding radiation element 420.

The first radiation element 430 includes a bending portion 435, which may substantially have a convex pentagonal shape, and thus the first radiation element 430 has a variable-width structure. Specifically, the first radiation element 430 has a first end 431 and a second end 432. The first end 431 of the first radiation element 430 is coupled to the first connection point CP4 on the feeding radiation element 420. The second end 432 of the first radiation element 430 is an open end. The bending portion 435 of the first radiation element 430 is positioned at the second end 432 of the first radiation element 430.

The second radiation element 440 may substantially have a relatively wide straight-line shape, which may be substantially perpendicular to the feeding radiation element 420. Specifically, the second radiation element 440 has a first end 441 and a second end 442. The first end 441 of the second radiation element 440 is coupled to the second connection point CP5 on the feeding radiation element 420. The second end 442 of the second radiation element 440 is an open end. The second end 442 of the second radiation element 440 is adjacent to the bending portion 435 of the first radiation element 430, but is completely separate from the bending portion 435 of the first radiation element 430. The second radiation element 440 is not parallel to the first radiation element 430. For example, an acute angle $\theta 2$ may be formed between the second radiation element 440 and the bending portion 435 of the first radiation element 430.

The third radiation element 450 may have an irregular shape. The grounding point GP2 is positioned at a corner of the third radiation element 450. The third radiation element 450 is coupled to the third connection point CP6 of the feeding radiation element 420. Specifically, the third radiation element 450 includes a first protruding portion 460 and a second protruding portion 470. The first protruding portion 460 of the third radiation element 450 may substantially have a relatively narrow trapezoidal shape with an open end 461. The second protruding portion 470 of the third radiation element 450 may substantially have a relatively wide rectangular shape with an open end 471. The first protruding portion 460 and the second protruding portion 470 of the third radiation element 450 substantially extend in opposite directions and away from each other. For example, the open end 461 of the first protruding portion 460 may extend parallel to the −X axis, and the open end 471 of the second protruding portion 470 may extend parallel to the +X axis, but they are not limited thereto. In some embodiments, a monopole slot 480 is formed between the feeding radiation element 420 and the third radiation element 450. The feeding point FP2 and the grounding point GP2 are positioned at two opposite sides of the monopole slot 480.

Figure 5:
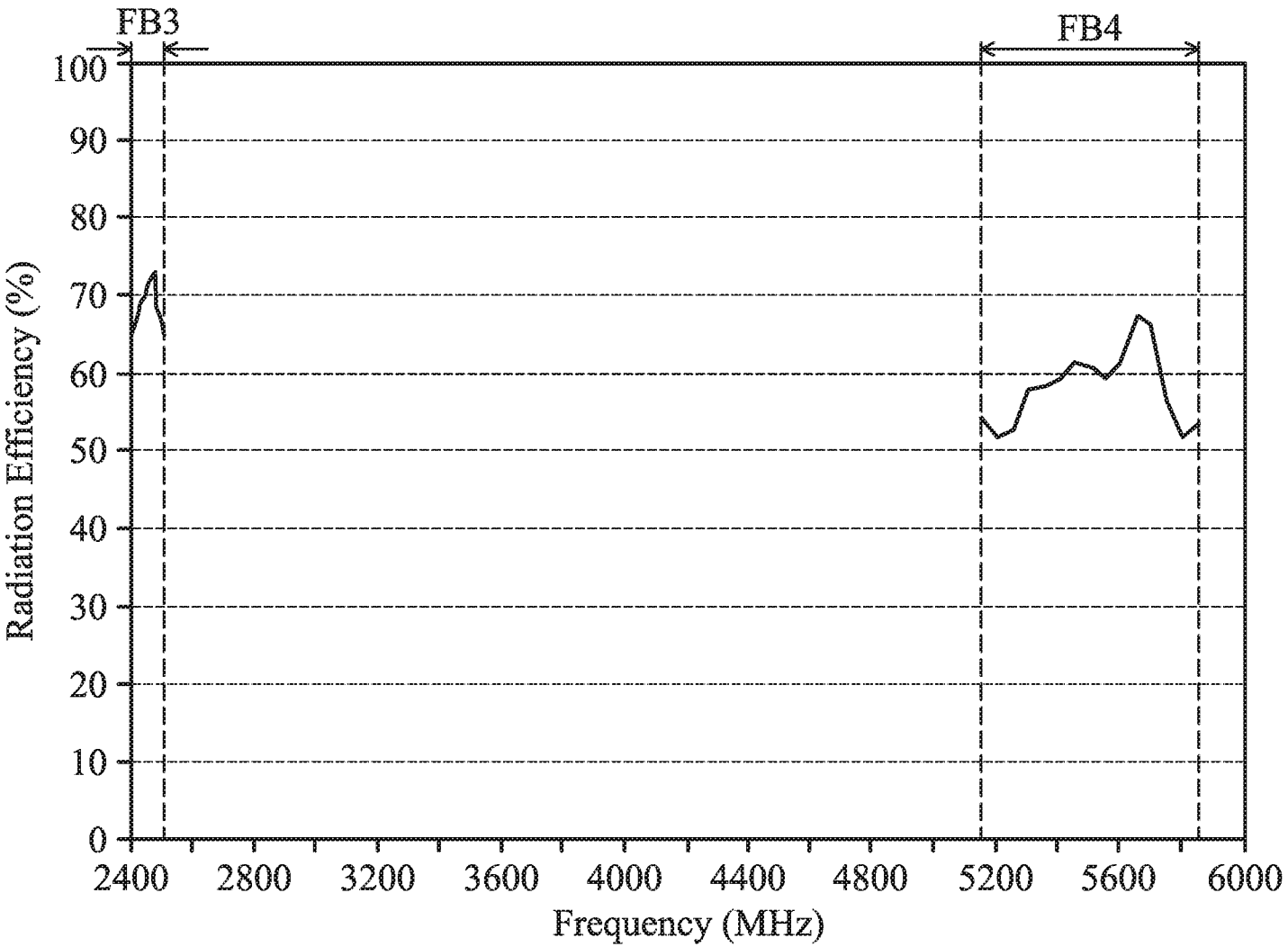
FIG. 5 is a diagram of radiation efficiency of an antenna structure according to another embodiment of the invention.

FIG. 5 is a diagram of radiation efficiency of the antenna structure 400 according to another embodiment of the invention. The horizontal axis represents the operation frequency (MHz), and the vertical axis represents the radiation efficiency (%). According to the measurement of FIG. 5, the antenna structure 400 can cover a first frequency band FB3 and a second frequency band FB4. The first frequency band FB3 may be from 2400 MHz to 2500 MHz. The second frequency band FB4 may be from 5150 MHz to 5850 MHz. Furthermore, within the first frequency band FB3 and the second frequency band FB4, the radiation efficiency of the antenna structure 400 can reach 50% or higher, and it can meet the requirements of practical application of general mobile communication devices.

In some embodiments, the operation principles of the antenna structure 400 are described as follows. A first resonant path PA5 is formed from the feeding point FP2 through the first connection point CP4 to the second end 432 of the first radiation element 430. A second resonant path PA6 is formed from the feeding point FP2 through the second connection point CP5 to the second end 442 of the second radiation element 440. Both the first resonant path PA5 and the second resonant path PA6 are excited to generate the first frequency band FB3. A third resonant path PA7 is formed from the grounding point GP2 through the third radiation element 450 to the open end 461 of the first protruding portion 460. A fourth resonant path PA8 is formed from the grounding point GP2 through the third radiation element 450 to the open end 471 of the second protruding portion 470. Both the third resonant path PA7 and the fourth resonant path PA8 are excited to generate the second frequency band FB4.

In some embodiments, the element sizes of the antenna structure 400 are described as follows. The length of the first resonant path PA5 may be substantially equal to 0.25 wavelength (λ/4) of the first frequency band FB3. The length of the second resonant path PA6 may be substantially equal to 0.25 wavelength (λ/4) of the first frequency band FB3. The length of the third resonant path PA7 may be substantially equal to 0.25 wavelength (λ/4) of the second frequency band FB4. The length of the fourth resonant path PA8 may be substantially equal to 0.25 wavelength (λ/4) of the second frequency band FB4. The width W8 of the first radiation element 430 may be 3 to 5 times the width W7 of the feeding radiation element 420. The width W8 of the first radiation element 430 may be 1.1 to 1.8 times the width W9 of the second radiation element 440. Among the third radiation element 450, the width W11 of the second protruding portion 470 may be 2 to 5 times the width W10 of the first protruding portion 460. The width W12 of the monopole slot 480 may be from 1 mm to 2 mm. The acute angle θ2 may be from 0 to 45 degrees. The above ranges of element sizes are calculated and obtained according to many experiment results, and they help to optimize the operation bandwidth and impedance matching of the antenna structure 400.

It should be noted that the proposed antenna structure 100 (or 400) may be planar or 3D (Three-Dimensional), without affecting the performance of the invention. In addition, according to practical measurements, if the proposed antenna structure 100 (or 400) is disposed around a Bluetooth antenna, the isolation between the two antennas can reach at least 15 dB. Therefore, the invention can be applied to wideband operations of general MIMO (Multi-Input and Multi-Output) systems.

The invention proposes a novel antenna structure. In comparison to the conventional antenna design, it has at least the advantages of small size, wide bandwidth, high isolation, and low manufacturing cost. Therefore, the antenna structure of the invention is suitable for application in a variety of current small-size mobile communication devices.

Note that the above element sizes, element shapes, and frequency ranges are not limitations of the invention. An antenna designer can fine-tune these settings or values according to different requirements. It should be understood that the antenna structure of the invention is not limited to the configurations of FIGS. 1-5. The invention may include any one or more features of any one or more embodiments of FIGS. 1-5. In other words, not all of the features displayed in the figures should be implemented in the antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

It will be apparent to those skilled in the art that various modifications and variations can be made in the invention. It is intended that the standard and examples be considered as exemplary only, with the true scope of the disclosed embodiments being indicated by the following claims and their equivalents.

What is claimed is:

1. An antenna structure, comprising:

a feeding radiation element, having a feeding point;

a first radiation element, coupled to a first connection point on the feeding radiation element, wherein the first radiation element comprises a bending portion;

a second radiation element, coupled to a second connection point on the feeding radiation element, and disposed adjacent to the bending portion, wherein the second radiation element is not parallel to the first radiation element; and a third radiation element, having a grounding point, and coupled to a third connection point on the feeding radiation element, wherein the third radiation element comprises a first protruding portion and a second protruding portion, and the first protruding portion and the second protruding portion extend in different directions;

wherein the antenna structure covers a first frequency band and a second frequency band;

wherein a first resonant path is formed from the feeding point through the first connection point to an open end of the first radiation element, and a length of the first resonant path is substantially equal to 0.25 wavelength of the first frequency band.

2. The antenna structure as claimed in claim 1, wherein the feeding radiation element substantially has a relatively narrow straight-line shape.

3. The antenna structure as claimed in claim 1, wherein an acute angle is formed between the second radiation element and the bending portion of the first radiation element.

4. The antenna structure as claimed in claim 1, wherein the second radiation element substantially has a relatively wide straight-line shape.

5. The antenna structure as claimed in claim 1, wherein the second radiation element is substantially perpendicular to the feeding radiation element.

6. The antenna structure as claimed in claim 1, wherein the first radiation element and the second radiation element are positioned a side of the feeding radiation element, and the third radiation element is positioned on an opposite side of the feeding radiation element.

7. The antenna structure as claimed in claim 1, wherein a monopole slot is formed between the feeding radiation element and the third radiation element.

8. The antenna structure as claimed in claim 7, wherein the feeding point and the grounding point are positioned at two opposite sides of the monopole slot.

9. The antenna structure as claimed in claim 1, wherein the first protruding portion of the third radiation element substantially has a relatively narrow rectangular shape or a relatively narrow trapezoidal shape.

10. The antenna structure as claimed in claim 1, wherein the second protruding portion of the third radiation element substantially has a relatively wide rectangular shape.

11. The antenna structure as claimed in claim 1, wherein the first protruding portion and the second protruding portion of the third radiation element substantially extend in orthogonal directions.

12. The antenna structure as claimed in claim 1, wherein the first protruding portion and the second protruding portion of the third radiation element substantially extend in opposite directions.

13. The antenna structure as claimed in claim 1, wherein the first frequency band is from 2400 MHz to 2500 MHz, and the second frequency band is from 5150 MHz to 5850 MHz.

14. The antenna structure as claimed in claim 13, wherein a second resonant path is formed from the feeding point through the second connection point to an open end of the second radiation element, and a length of the second resonant path is substantially equal to 0.25 wavelength of the first frequency band.

15. The antenna structure as claimed in claim 13, wherein a third resonant path is formed from the grounding point through the third radiation element to an open end of the first protruding portion, and a length of the third resonant path is substantially equal to 0.25 wavelength of the second frequency band.

16. The antenna structure as claimed in claim 13, wherein a fourth resonant path is formed from the grounding point through the third radiation element to an open end of the second protruding portion, and a length of the fourth resonant path is substantially equal to 0.25 wavelength of the second frequency band.

* * * * *